United States Patent [19]

Musto et al.

[11] Patent Number: 4,535,477

[45] Date of Patent: Aug. 20, 1985

[54] DRY SUIT

[75] Inventors: Franklyn K. Musto; Hugh E. Bourn; John Buchanan; Duncan A. Kay, all of Essex, England

[73] Assignee: Musto & Hyde Accessories Ltd., Essex, England

[21] Appl. No.: 594,319

[22] Filed: Mar. 28, 1984

[30] Foreign Application Priority Data

Mar. 29, 1983 [GB] United Kingdom ..... 8308636

[51] Int. Cl.[3] ..... B63C 11/04

[52] U.S. Cl. ..... 2/2.1 R

[58] Field of Search ..... 2/2.1 R

[56] References Cited

U.S. PATENT DOCUMENTS

| | | | |
|---|---|---|---|
| 2,570,019 | 10/1951 | Wolk | 2/2.1 R |
| 2,853,758 | 9/1958 | Topf | 2/2.1 R |
| 3,744,054 | 7/1973 | Schultz | 2/2.1 R |
| 4,227,262 | 10/1980 | Insulan et al. | 2/2.1 R |

FOREIGN PATENT DOCUMENTS

| | | | |
|---|---|---|---|
| 979205 | 12/1950 | France | 2/2.1 R |

*Primary Examiner*—Louis K. Rimrodt

*Attorney, Agent, or Firm*—Watson, Cole, Grindle & Watson

[57] ABSTRACT

In a two piece dry suit having sealing bands (5,13) for producing a rolled seal between the two pieces (1,10) at the waist of the suit, an integral flap (6) is provided at the bottom of the suit jacket (1) and is adapted to overlie the rolled seal (14) to secure the seal in the rolled condition.

5 Claims, 6 Drawing Figures

DRY SUIT

This invention relates to a dry suit intended to be worn for aquatic activities and in particular water sports and pastimes, e.g. board sailing and water skiing.

It is known to provide a two-piece dry suit comprising trousers and a jacket top which are interconnected at the waist by a so-called rolled seal. Annular rubber sealing flaps are attached to the waist of the trousers and to the bottom edge of the jacket and are adapted to lie one over the other when the two pieces of the suit are put on. To make the seal the two flaps are rolled up together from their free lower edges, and to prevent the seal unrolling a separate tight-fitting belt or cummerbund is applied around the waist over the rolled seal. The belt applies considerable pressure to the stomach region of the wearer, which does not constitute a serious disadvantage for divers operating at depths where substantial pressures are experienced. For others, however, such as board sailors who spend their time at or above the water surface the pressure from the suit belt can cause much discomfort. Attempts have been made to overcome this disadvantage by eliminating the rolled seal and providing a one piece suit, but the single piece suits have not proved entirely satisfactory since they are very difficult for a person to get into and out of without any assistance.

The present invention aims at an alternative solution to the problem mentioned above and accordingly provides a two-piece dry suit having sealing bands for producing a rolled seal between the two pieces at the waist of the suit, and wherein a part is securely fastened to one piece of the suit at a position to one side of the rolled seal and is arranged to overlie and extend across the rolled seal into cooperation with the other piece of the suit for securing the seal in the rolled condition.

It is expedient for the seal securing part to comprise a flap portion attached integrally to the one piece of the suit and to have means for holding it in cooperation with the other piece of the suit.

In a preferred form of suit embodying the invention, described in more detail below, the flap portion is constituted by a welt band fastened to the bottom edge of the suit jacket and incorporating an elasticated bottom seam. In this preferred embodiment the flap extends continuously around the entire bottom edge of the jacket. As an alternative to a flap of this form, the suit may comprise at least one tongue, or more preferably a series of tongues spaced apart around the suit in the region of the waist to extend across the outside of the rolled seal, each tongue being fastened by one end to the jacket and having means at the other end to hold it against the trousers below the seal. The lower end of each tongue could, for example, be equipped with one part of a releasable fastener, such as a press-stud, for cooperation with a complementary fastener part fixed to the trousers. While the use of tongues to secure the rolled seal is possible, it has the disadvantage of leaving exposed parts of the rolled seal and thereby reducing the aesthetic appeal of the suit.

A full understanding of the invention will be had from the following description given with reference to the accompanying drawings, in which:

FIG. 2 is a front view of the bottom or trousers of the suit, shown being worn ready for the top to be put on.

Figure 1:
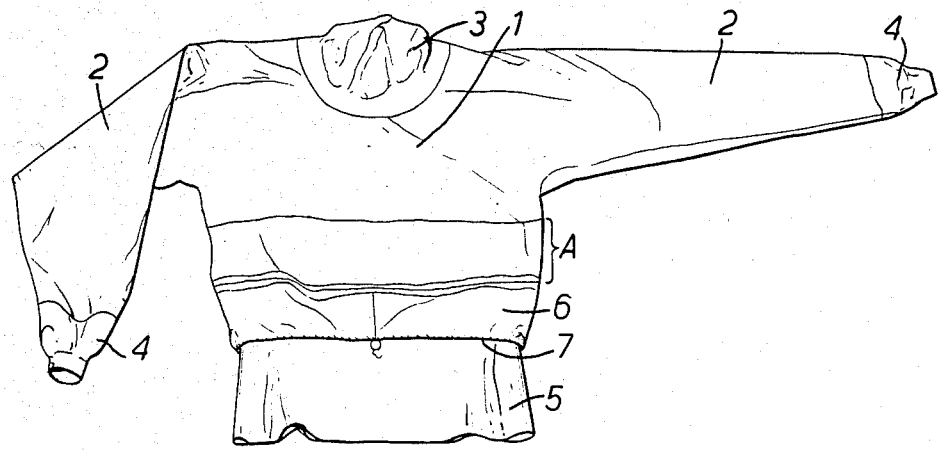
FIG. 1 is a front view of the top or jacket of a suit according to the invention.

The suit top shown in FIG. 1 comprises a body part 1, sleeves 2, a neck seal 3 fastened to the body part around the neck opening therein, and wrist seals 4 fastened to the ends of the sleeves. Attached and sealed to the inside of the body 1 in a region A by means of adhesive is an annular rubber band 5 defining a sealing skirt projecting downwardly from the bottom edge of the suit top. The region A is spaced from the bottom edge by at least a few inches, e.g. about 6–8 inches (10–15 cms), to leave a free welt flap 6 which is integrally attached to the body 2. The free lower edge of the welt flap 6 is provided with an elasticated seam 7. In place of the elasticated seam a draw string could be used, or releasable fastener elements, such as press studs could be provided on the flap for cooperation with corresponding elements fitted to the suit trousers.

Figure 2:
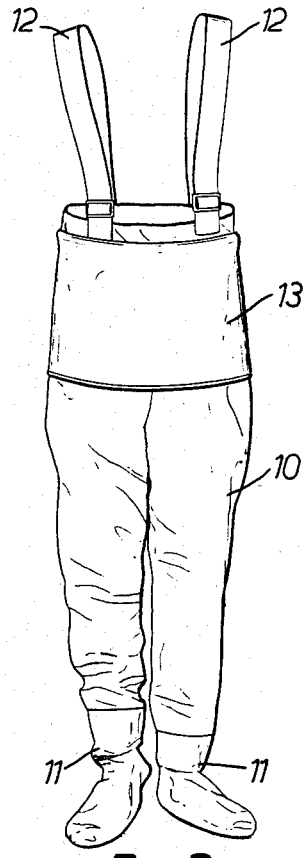

In FIG. 2 the trousers 10 of the suit are shown. Attached to the lower ends of the trouser legs are socks 11, but if preferred ankle seals could be attached instead of the socks. Sewn to the waist of the trousers are adjustable shoulder straps 12, and attached to the outside of the trousers by adhesive at a short distance below the waist is an annular rubber band 13 forming a sealing skirt which, when the trousers are put on is adjusted to extend downwardly over the trousers to its free edge as seen in FIG. 2.

Figure 3:
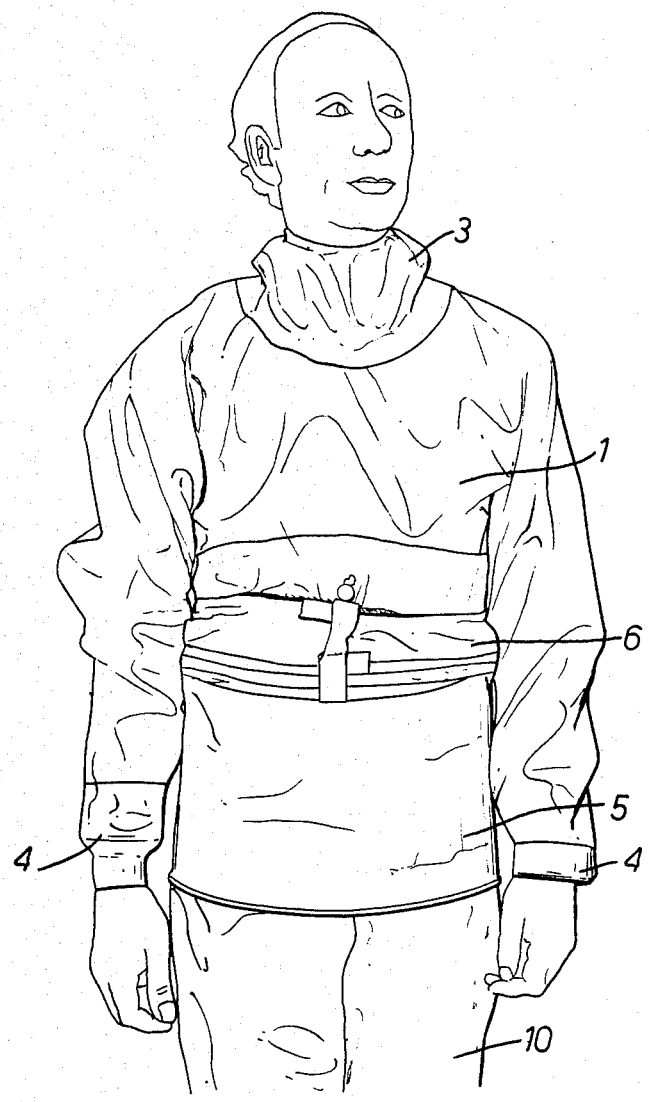
FIGS. 3 to 6 show successive stages during completion of the rolled seal between the two suit pieces.
Figure 4:
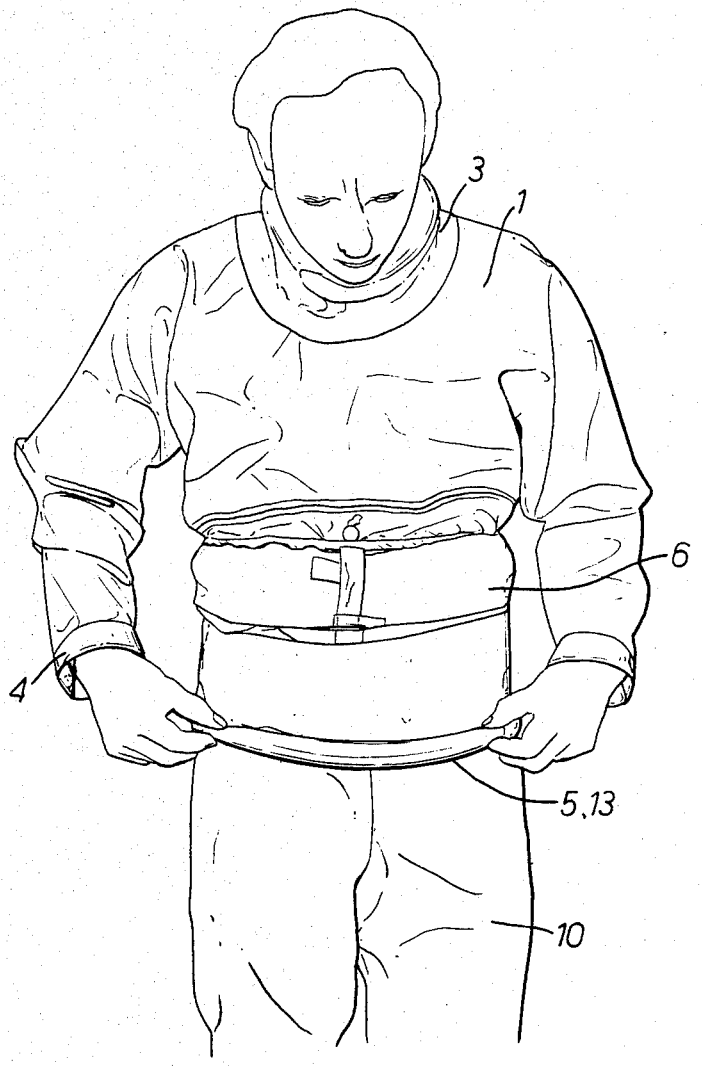
Figure 5:
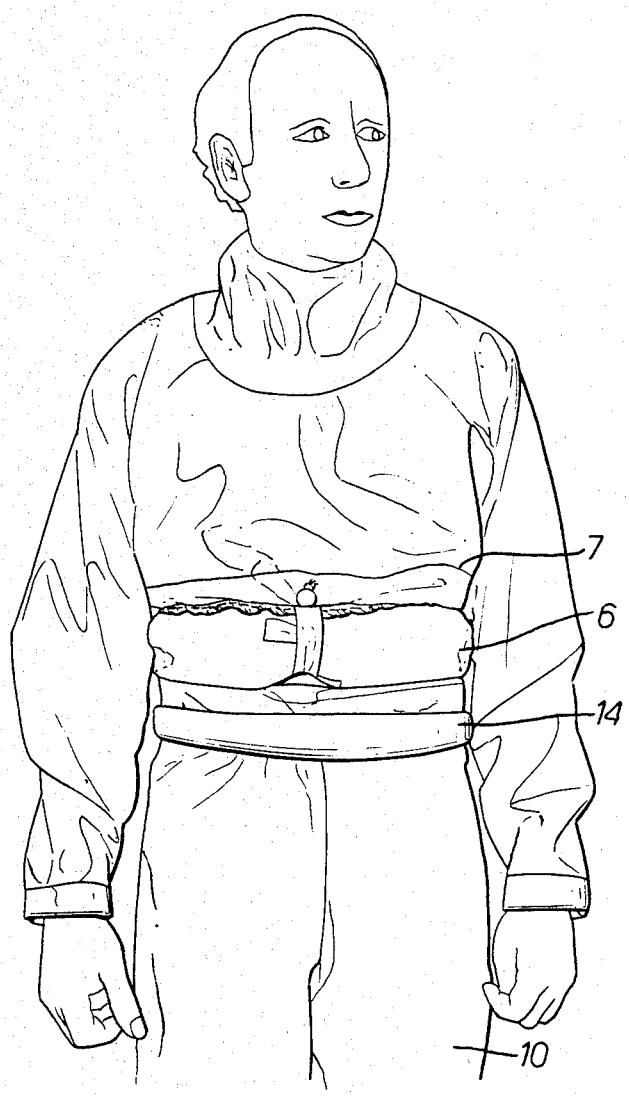
Figure 6:
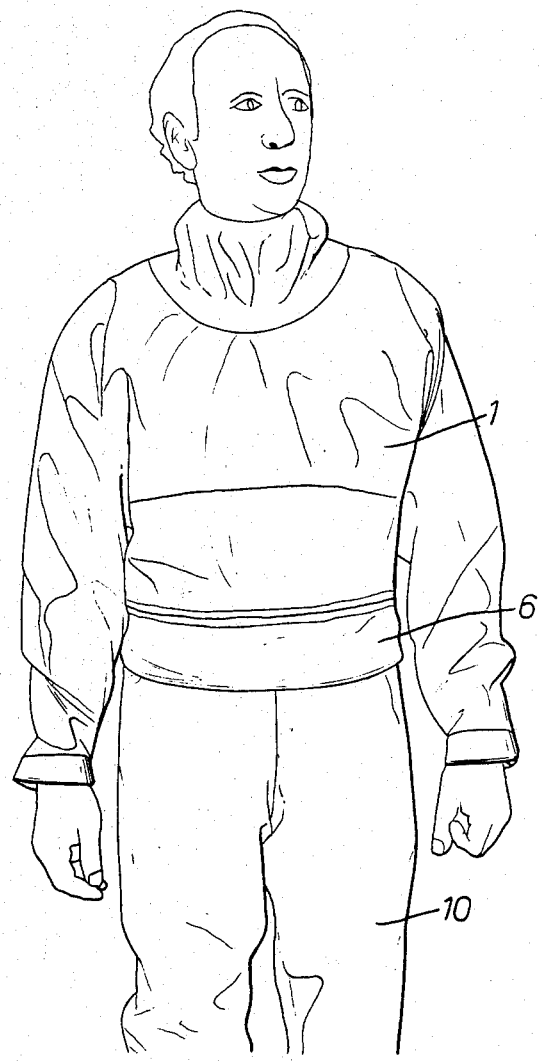

The suit top is put on after the trousers and the seal skirt 5 of the top is arranged to overlie that of the trousers (FIG. 3). With the welt flap 6 turned up the two skirts 5 are rolled up together from their free lower edges (FIG. 4). When the seal has been fully rolled (FIG. 5) the welt flap 6 of the top is turned down over the rolled seal 14 and its elasticated seam 7 is tucked in under the roll (FIG. 6). The sealed connection between the two parts of the suit is now complete and the rolled seal is held effectively against unrolling by the welt flap 6. Thus the seal is retained in the rolled up condition in a neat and simple manner without applying any pressure likely to cause discomfort to the wearer.

We claim:

1. A two-piece dry suit comprising top and bottom suit pieces having respective sealing bands for producing a rolled seal between said suit pieces at the waist of the suit, and a part securely fastened to one of said pieces at a position to one side of the rolled seal, said part being adapted to overlie and extend around said rolled seal so as to terminate between said rolled seal and the other of said pieces, and including means to hold said part in firm engagement with said other piece, whereby said part retains the seal securely in the rolled condition without any additional securing device being applied to the suit.

2. A two-piece dry suit as defined in claim 1, wherein said seal securing part comprises a flap portion formed by an integral extension on said one piece of the suit.

3. A two-piece dry suit as defined in claim 2, wherein the holding means comprises a tension element included in the free edge portion of the flap so as to extend around the body of a person wearing the suit, said element being tensioned to urge said securing part against said other piece of the suit upon positioning the flap over the rolled seal.

4. A two-piece dry suit as defined in claim 3, wherein said tension element is elasticated and is tensioned by stretching.

5. A two-piece dry suit comprising top and bottom suit pieces having respective sealing bands for producing a rolled seal between said suit pieces at the waist of the suit, the sealing band of the top piece of the suit being attached to the inside of said top piece at a position spaced from the bottom edge of said top piece whereby to define an integral welt band, said welt band forming a flap adapted to overlie and surround the rolled seal so as to terminate between the rolled seal and the bottom piece of the suit, and said welt band having an elasticated lower edge seam to hold said flap against the bottom piece of the suit, said flap and said seam constituting sole means provided to retain the seal securely in the rolled condition.

* * * * *